US010612850B2

(12) United States Patent
Biel et al.

(10) Patent No.: US 10,612,850 B2
(45) **Date of Patent: *Apr. 7, 2020**

(54) SYSTEM AND METHOD FOR DYNAMICALLY ADJUSTING DRYER BELT SPEED

(71) Applicant: M&R Printing Equipment, Inc., Roselle, IL (US)

(72) Inventors: Boguslaw Biel, Carol Stream, IL (US); Radu Suciu, Glen Ellyn, IL (US)

(73) Assignee: M&R Printing Equipment, Inc., Roselle, IL (US)

( * ) Notice: Subject to any disclaimer, the term of this patent is extended or adjusted under 35 U.S.C. 154(b) by 57 days.

This patent is subject to a terminal disclaimer.

(21) Appl. No.: 15/959,803

(22) Filed: Apr. 23, 2018

(65) Prior Publication Data

US 2018/0306505 A1 Oct. 25, 2018

Related U.S. Application Data

(63) Continuation of application No. 15/251,547, filed on Aug. 30, 2016, now Pat. No. 9,951,991.

(60) Provisional application No. 62/212,154, filed on Aug. 31, 2015.

(51) Int. Cl.

| | |
|---|---|
| ***F26B 21/10*** | (2006.01) |
| ***F26B 15/18*** | (2006.01) |
| ***D06F 60/00*** | (2009.01) |
| ***D06F 58/12*** | (2006.01) |
| ***D06F 58/28*** | (2006.01) |

(52) U.S. Cl.

CPC ..... *F26B 21/10* (2013.01); *D06F 58/12* (2013.01); *D06F 60/00* (2013.01); *F26B 15/18* (2013.01); *D06F 58/28* (2013.01); *D06F 2058/2877* (2013.01)

(58) Field of Classification Search

CPC ..... F26B 21/10; F26B 15/18; D06F 58/12; D06F 60/00; D06F 58/28; D06F 2058/2877

USPC ..... 34/485, 611–665

See application file for complete search history.

(56) References Cited

U.S. PATENT DOCUMENTS

| | | | |
|---|---|---|---|
| 1,329,082 | A | 1/1920 | Irwin |
| 1,407,081 | A | 2/1922 | Parkes |
| 1,900,586 | A | 3/1933 | Rippe |
| 2,184,905 | A | 12/1939 | Brintnall |

(Continued)

FOREIGN PATENT DOCUMENTS

| | | | |
|---|---|---|---|
| CN | 103015103 | A | 4/2013 |
| DE | 4236123 | C1 | 2/1994 |

(Continued)

OTHER PUBLICATIONS

Rhodefer, B.; Google search results: "Re: Need AC zero cross detection circuit"; Newsgroups sci.electronics.de; Aug. 25, 1997; retrieved from Internet on Apr. 23, 2003 (2 pages).

(Continued)

*Primary Examiner* — Stephen M Gravini

(74) *Attorney, Agent, or Firm* — Greensfelder, Hemker & Gale, P.C.; Richard C. Himelhoch

(57) ABSTRACT

A dynamically adjustable textile dryer and method of controlling a conveyor belt speed of the textile dryer is provided. The speed of the belt is utilized to more quickly adjust the temperature of the drying chamber.

20 Claims, 4 Drawing Sheets

(56) References Cited

U.S. PATENT DOCUMENTS

| | | | |
|---|---|---|---|
| 2,432,525 | A | 12/1947 | Kruse |
| 2,512,128 | A | 6/1950 | Albright |
| 3,259,995 | A | 7/1966 | Powischill |
| 3,350,789 | A | 11/1967 | Davies |
| 3,395,459 | A | 8/1968 | Taylor |
| 3,512,989 | A | 5/1970 | Smith |
| 3,732,435 | A | 5/1973 | Strandberg, Jr. et al. |
| 3,751,267 | A | 8/1973 | Sachnik |
| 3,795,189 | A | 3/1974 | Jaffa |
| 3,928,703 | A | 12/1975 | Cook |
| 3,943,842 | A | 3/1976 | Bills et al. |
| 3,982,301 | A | 9/1976 | Llach et al. |
| 4,086,393 | A | 4/1978 | Hart |
| 4,112,587 | A | 9/1978 | Sundman |
| 4,192,751 | A | 3/1980 | Henton et al. |
| 4,248,150 | A | 2/1981 | Lala |
| 4,261,288 | A | 4/1981 | Jurascheck et al. |
| 4,380,191 | A | 4/1983 | Gallegos et al. |
| 4,385,452 | A | 5/1983 | Deschaaf et al. |
| 4,451,357 | A | 5/1984 | LaVigne |
| 4,491,610 | A | 1/1985 | Mansour |
| 4,495,021 | A | 1/1985 | Goldsworthy |
| 4,498,941 | A | 2/1985 | Goldsworthy |
| 4,520,750 | A | 6/1985 | Mansour |
| 4,554,437 | A | 11/1985 | Wagner et al. |
| 4,557,372 | A | 12/1985 | Rajagopal |
| 4,567,673 | A | 2/1986 | Bohnensieker |
| 4,698,767 | A | 10/1987 | Wensel et al. |
| 5,021,940 | A | 6/1991 | Cox et al. |
| 5,023,429 | A | 6/1991 | Bailey et al. |
| 5,093,963 | A | 3/1992 | Farrington et al. |
| 5,117,562 | A | 6/1992 | Dulay et al. |
| 5,144,108 | A | 9/1992 | Passarotto |
| 5,218,908 | A | 6/1993 | Whitfield |
| 5,225,880 | A | 7/1993 | Shehata et al. |
| 5,239,613 | A | 8/1993 | Motev et al. |
| 5,279,697 | A | 1/1994 | Peterson et al. |
| 5,361,515 | A | 11/1994 | Peremyschev |
| 5,397,749 | A | 3/1995 | Igarashi |
| 5,426,280 | A | 6/1995 | Smith |
| 5,447,003 | A | 9/1995 | Warren et al. |
| 5,456,172 | A | 10/1995 | Herrman |
| 5,489,981 | A | 2/1996 | Killpatrick et al. |
| 5,538,562 | A | 7/1996 | Misaki |
| 5,575,206 | A | 11/1996 | Szyszko |
| 5,607,243 | A | 3/1997 | Szarka |
| 5,634,281 | A | 6/1997 | Nugent |
| 5,640,905 | A | 6/1997 | Szyszko et al. |
| 5,651,191 | A | 7/1997 | Walunas et al. |
| 5,655,312 | A | 8/1997 | Sevcik |
| 5,669,155 | A | 9/1997 | Hughes et al. |
| 5,797,598 | A | 8/1998 | Marschke et al. |
| 5,813,134 | A | 9/1998 | Min et al. |
| 5,828,178 | A | 10/1998 | York et al. |
| 5,832,627 | A | 11/1998 | Hiebert |
| 5,852,881 | A | 12/1998 | Kuroda et al. |
| 5,887,519 | A | 3/1999 | Zelko |
| 5,908,000 | A | 6/1999 | Spychalla et al. |
| 5,937,535 | A | 8/1999 | Hoffman, Jr. et al. |
| 6,026,588 | A | 2/2000 | Clark et al. |
| 6,089,149 | A | 7/2000 | Zelko |
| 6,104,003 | A | 8/2000 | Jones |
| 6,112,654 | A | 9/2000 | Jaffa |
| 6,161,304 | A | 12/2000 | Iaccino et al. |
| 6,182,375 | B1 | 2/2001 | Banerjee |
| 6,203,151 | B1 | 3/2001 | Ruhe |
| 6,289,802 | B1 | 9/2001 | Zelko |
| 6,327,994 | B1 | 12/2001 | Labrador |
| 6,340,225 | B1 | 1/2002 | Szlucha |
| 6,388,690 | B1 | 5/2002 | Kurachi |
| 6,430,841 | B1 | 8/2002 | Borkowski et al. |
| 6,456,826 | B1 | 9/2002 | Toskala et al. |
| 6,624,396 | B2 | 9/2003 | Witt et al. |
| 6,725,009 | B1 | 4/2004 | Tatematsu et al. |
| 6,751,888 | B2 | 6/2004 | Lueckenbach |
| 6,760,981 | B2 | 7/2004 | Leap |
| 6,779,279 | B2 | 8/2004 | Lee et al. |
| 7,073,274 | B2 | 7/2006 | Yoshida |
| 7,850,820 | B2 | 12/2010 | Scherb et al. |
| 7,877,895 | B2 | 2/2011 | Otsuka et al. |
| 8,371,285 | B2 | 2/2013 | Wiker et al. |
| 8,528,231 | B2 | 9/2013 | Kim et al. |
| 8,726,533 | B2 * | 5/2014 | Cai ..... F26B 21/02 110/233 |
| 8,726,553 | B2 | 5/2014 | Cai et al. |
| 9,150,041 | B2 | 10/2015 | Biel et al. |
| 9,393,773 | B2 | 7/2016 | Hoffman, Jr. et al. |
| 9,534,840 | B2 | 1/2017 | Pahwa et al. |
| 9,651,303 | B2 | 5/2017 | Vinyard et al. |
| 9,671,166 | B2 | 6/2017 | Plavnik et al. |
| 9,939,198 | B2 | 4/2018 | Hoffman, Jr. et al. |
| 9,951,991 | B2 * | 4/2018 | Biel ..... F26B 21/10 |
| 10,113,795 | B2 | 10/2018 | Hoffman, Jr. et al. |
| 2003/0039492 | A1 | 2/2003 | Hamada et al. |
| 2003/0042248 | A1 | 3/2003 | Witt et al. |
| 2003/0121430 | A1 | 7/2003 | Eppinger |
| 2004/0000240 | A1 | 1/2004 | Oleson |
| 2005/0209936 | A1 | 9/2005 | Guy |
| 2005/0223918 | A1 | 10/2005 | Steffen et al. |
| 2005/0252394 | A1 | 11/2005 | Eppinger |
| 2006/0249039 | A1 | 11/2006 | Feldman et al. |
| 2006/0266232 | A1 | 11/2006 | Macchi |
| 2007/0144033 | A1 | 6/2007 | Kocjan et al. |
| 2007/0193056 | A1 | 8/2007 | Switalski |
| 2008/0056742 | A1 | 3/2008 | Hattori et al. |
| 2010/0107436 | A1 | 5/2010 | Velardi et al. |
| 2010/0236196 | A1 | 9/2010 | Pazdernik et al. |
| 2011/0059412 | A1 | 3/2011 | Wiedemeier |
| 2012/0187105 | A1 | 7/2012 | Parks et al. |
| 2014/0047731 | A1 | 2/2014 | Quirk et al. |
| 2014/0261029 | A1 | 9/2014 | Oleson |
| 2015/0291366 | A1 | 10/2015 | Cumberlege |
| 2016/0025411 | A1 | 1/2016 | Plavnik et al. |
| 2017/0030645 | A1 | 2/2017 | Hoffman, Jr. et al. |
| 2017/0059244 | A1 | 3/2017 | Biel et al. |
| 2017/0067687 | A1 | 3/2017 | Hoffman, Jr. et al. |
| 2018/0306505 | A1 * | 10/2018 | Biel ..... F26B 21/10 |

FOREIGN PATENT DOCUMENTS

| | | | |
|---|---|---|---|
| FR | 2614546 | A1 | 11/1988 |
| GB | 2249824 | A | 5/1995 |
| GB | 2357827 | A | 7/2001 |
| IT | 1316230 | | 4/2003 |
| WO | 9319337 | A1 | 9/1993 |
| WO | 2009105693 | A2 | 8/2009 |
| WO | 2011042012 | A1 | 4/2011 |
| WO | 2018052999 | A1 | 3/2018 |

OTHER PUBLICATIONS

M&R Printing Equipment, Inc.; Web page for "Product Index: Textile Printing: Mini Sprint" printer; retrieved from Internet May 23, 2005 (2 pages).

M&R Printing Equipment, Inc.; Web page for "Product Index: Textile Printing: Sprint 2000" printer; retrieved from Internet May 23, 2005 (2 pages).

M&R Printing Equipment, Inc.; Web page for "Product Index: Textile Printing: Sprint 2000 HO" printer; retrieved from Internet May 23, 2005 (2 pages).

M&R Sales & Service, Inc.; Product Catalog for Textile Screen Printing Equipment: Mini Sprint, Sprint 2000, and Sprint 2000 HO models; pp. 7-8, published 2001 (3 pages).

M&R Sales & Service, Inc.; Product Catalog for Textile Screen Printing Equipment: Sprint Modular Textile Gas Dryer and Sprint SS Modular Textile Gas Dryer; pp. 23-24; undated (3 pages).

Korean Intellectual Property Office, International Application Division; International Search Report for International Application No. PCT/US2017/051361; dated Jan. 11, 2018 (3 pages).

Korean Intellectual Property Office, International Application Division; Written Opinion of the International Searching Authority for

(56) References Cited

OTHER PUBLICATIONS

International Application No. PCT/US2017/051361; dated Jan. 11, 2018 (7 pages).

* cited by examiner

SYSTEM AND METHOD FOR DYNAMICALLY ADJUSTING DRYER BELT SPEED

CROSS-REFERENCE TO RELATED APPLICATIONS

The present invention is a continuation of U.S. patent application Ser. No. 15/251,547 filed Aug. 30, 2016, which claims the benefit of U.S. Provisional Patent Application No. 62/212,154 filed Aug. 31, 2015, the contents of which are incorporated herein by reference.

FEDERALLY SPONSORED RESEARCH OR DEVELOPMENT

N/A

FIELD OF THE INVENTION

The present invention generally relates to a system and method for dynamically adjusting the speed of a dryer belt of a textile dryer for optimal performance.

BACKGROUND OF THE INVENTION

Textile dryers typically include conveyor belts that transport a textile item, such as a shirt that has been in a silk screening or other printing operation, through a heated drying chamber. The conveyor belt, configured as an endless loop, travels at a constant speed through the heated chamber to allow the ink in the textile to set or cure.

The drying chamber can take a significant amount of time at start-up to come up to the appropriate drying temperature. This is due in part because too much heat is exhausted by the conveyor belt running at its normal speed. Similarly, the chamber can take a significant amount of time cooling down at the end of a run. Again, this is due in part to the exhaust rate of the conveyor belt at normal operating speeds.

During a drying run, the heat chamber can sometimes vary in temperature. In such situations, textiles traveling on a conveyor belt at normal operating speeds can potentially burn or insufficiently dry depending on whether the temperature increased or decreased, respectively.

The present invention provides a textile dryer that is configured to modify the conveyor belt speed to optimize conditions in the heated drying chamber. The present dryer saves time and energy, and provides a more consistently finished product.

SUMMARY OF THE INVENTION

The present invention provides a dynamically adjustable textile dryer and a method for controlling the dryer belt speed for optimal performance and temperature control of the dryer. The speed of the belt can be adjusted at start-up, shut-down, or during the middle of a drying run to more efficiently and quickly change the temperature in the dryer.

At start-up, the textile dryer is configured to run the conveyor belt at a slower than normal speed. In this mode, less heat is exhausted with the belt than when the belt is running at its normal (faster) operating speed used for curing printed textile items (e.g., decorated garments). This slower speed enables the dryer's heat chamber to come up to operating temperature more quickly. This expedites production by reducing the time and cost of dryer pre-heating, and saves energy.

At shut-down the belt is adjusted in the opposite direction. Before a dryer can be shut down, the heat chamber must be cooled or the portion of the belt which would be stopped in the chamber would melt—ruining the (expensive) belt. The present dryer is configured to increase the belt speed during this time. This introduces more fresh air into the heat chamber and pulls (exhausts) more heated air out of the chamber, thus reducing the temperature quickly (i.e., in a time period less than that of keeping the belt at its normal operating speed or slowing it down during this period).

The present textile dryer is also configured to adjust the belt speed during normal operation. During a run the heat chamber can sometimes vary in temperature (this can occur for a number of reasons, e.g., increase in load, change of ambient conditions around the dryer, etc.). Accordingly, the textile dryer increases the belt speed (if the temperature increases) or decreases the belt speed (if the temperature decreases).

In accordance with one embodiment of the invention, a textile dryer that can dynamically and quickly adjust temperature in the drying chamber is provided. The textile dryer comprises a controller (such as a PLC), a drying chamber, a temperature probe for sensing a temperature of the drying chamber operatively coupled to the controller and a moveable belt for transporting textile items through the drying chamber. The moveable belt is configured to draw ambient air into the drying chamber through an opening in a first end of the chamber and exhaust air from the drying chamber through an opening in a second end of the drying chamber. The dryer also includes a belt drive for moving the belt operatively coupled to the controller. The belt drive adjustably moves the belt at speeds set by the controller in response to a sensed temperature to more quickly adjust the temperature of the drying chamber to either increase the temperature (i.e., by slowing the belt speed and thus slowing the cooler ambient air being drawn in and the hotter chamber air from being exhausted due to the belt) or decrease the temperature (i.e., by increasing the belt speed and thus increasing the cooler ambient air being drawn in and the hotter air in the chamber being exhausted by the belt). A belt motion sensor can also be operatively coupled to the controller.

The controller can be configured (e.g., programmed) to operate the dryer to control the speed of the belt depending the condition of the dryer. For example, the controller at start-up of the dryer can be configured to initially run the belt at an initial first speed and to then run the belt at a second (i.e., normal) speed upon the dryer reaching a predetermined temperature where the first speed is slower than the second speed. This slower initial speed allows the heating chamber to come up to temperature more quickly than utilizing the normal (second) speed initially at start-up.

Additionally, the controller at shut-down of the dryer can be configured to increase the speed of the belt. This increased speed allows the drying chamber to cool more rapidly.

Moreover, the controller can be configured to monitor a temperature of the drying chamber and to adjust a speed of the belt based on the monitored temperature. Specifically, the controller can be configured to increase the speed of the belt if the monitored temperature goes above a predetermined temperature. Similarly, the controller can be configured to decrease the speed of the belt if the monitored temperature goes below a predetermined temperature. The predetermined value can be, for example, plus or minus 10° F.

In accordance with another embodiment, a method of operating a textile dryer with a controller is provided. The method comprises the steps of controlling a heating element to initiate heating a drying chamber of the textile dryer at start-up, controlling a conveyor belt to move at a first speed, sensing a temperature of the drying chamber, and controlling the conveyor belt to move at a second speed faster than the first speed upon sensing a predetermined temperature.

Additionally, the method can include controlling the heating element to shut down, and controlling the conveyor belt to move at a third speed faster than the second speed.

Additionally, the method can include sensing an increase in the temperature in the drying chamber and controlling the conveyor belt to move at a third speed faster than the second speed when the sensed temperature increases a predetermined value. Similarly, the method can include sensing a decrease in the temperature in the drying chamber and controlling the conveyor belt to move at a third speed slower than the second speed when the sensed temperature increases a predetermined value.

The step of sensing an increase in the temperature in the drying chamber can comprise sensing a first temperature and sensing a second temperature 10° F. greater than the first temperature. Similarly, the step of sensing an increase in the temperature in the drying chamber can comprise sensing a first temperature and sensing a second temperature 10° F. less than the first temperature.

In accordance with yet another aspect of the invention, a method of operating a textile dryer at shut down with a controller is provided. The method comprises the steps of controlling a heating element in a drying chamber of the textile dryer to shut down and increasing a conveyor belt speed.

In accordance with yet another embodiment of the invention, another method of operating a textile dryer with a controller is provided. The method comprises the steps of sensing a first temperature of a drying chamber of the textile dryer, sensing a second temperature of the drying chamber different from the first temperature, and one of increasing a conveyor belt speed of a conveyor belt if the second temperature is greater than the first temperature and decreasing the conveyor belt speed if the second temperature is less than the first temperature. The second temperature can be one of 10° F. higher than the first temperature and 10° lower than the first temperature.

Further aspects of the invention are disclosed in the Figures, and are described herein.

BRIEF DESCRIPTION OF THE DRAWINGS

To understand the present invention, it will now be described by way of example, with reference to the accompanying drawings in which.

DETAILED DESCRIPTION

Figure 1:
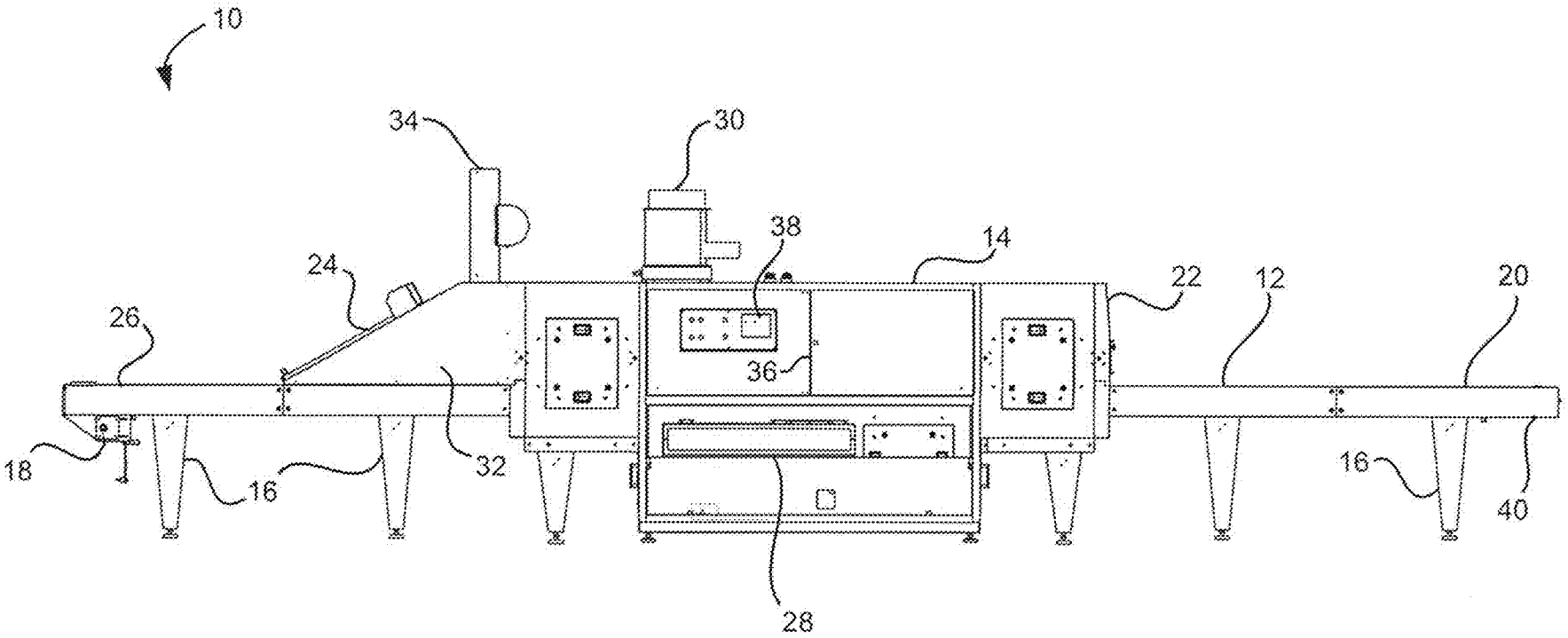
FIG. 1 is a schematic view of a textile dryer in accordance with the present invention.

While this invention is susceptible of embodiments in many different forms, there is shown in the drawings, and will herein be described in detail preferred embodiments of the invention with the understanding that the present disclosure is to be considered as an exemplification of the principles of the invention and is not intended to limit the broad aspect of the invention to the embodiments illustrated.

The present invention is directed to a textile dryer and method of operation for optimally heating and cooling a drying chamber by modifying the speed of a conveyor belt. Modification of the belt speed adjusts the amount of heat exhausted from the system.

FIG. 1 shows a textile dryer 10 having a conveyor belt 12 that is used to advance textiles through a drying or heated chamber 14. The belt 12 and drying chamber 14 are supported by legs 16.

The belt 12 is part of an endless loop that is moved by a belt drive 18. Textiles are placed on the belt 12 at a first end 20 and are moved through an opening 22 to the drying chamber 14 and out of an exit 24 to a second end 26. A belt motion sensor 40 is positioned proximate the first end 20 of the belt 12.

The dryer 10 includes a heating element, such as propane or natural gas burner 28, and a main exhaust 30. The dryer 10 can also include an end hood 32 and an end hood exhaust 34. In addition to the main exhaust 30 and end hood exhaust 34, heat is also exhausted by the belt 12 moving through the drying chamber 14 and through the exit 24. The belt 12 also draws in cooler air through the opening 22 from outside the chamber 14.

A temperature probe 36 is mounted for sensing the temperature of the drying chamber 14. More than one temperature probe—measuring different areas of the dryer 10 or chamber 14—can also be used. Additionally, other types of probes or sensors (e.g., humidity sensors) can be utilized with the dryer 10.

A controller 38, such as a PLC, is mounted to the side of the dryer 10. The controller 38 is electrically coupled to the relevant components of the dryer (e.g., heating elements, belt drive, temperature probe, etc.). The controller 38 is programmed to modify the belt speed for optimal performance of the dryer 10.

Figure 2:
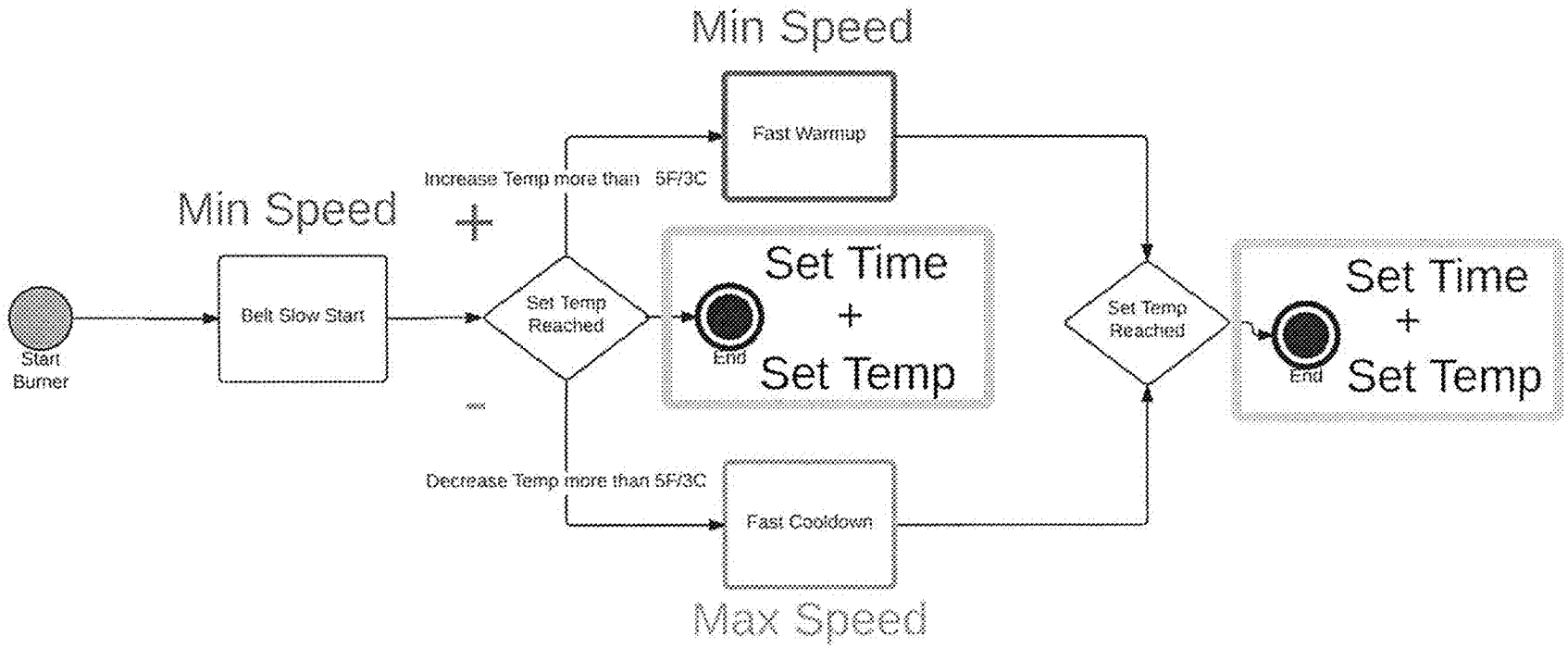
FIG. 2 is a process flow chart for controlling aspects of the textile dryer of FIG. 1 in accordance with the present invention.

Specifically, in accordance with one embodiment of the invention, the controller 38 is programmed to initiate a slower than normal belt speed during start-up of the dryer 10. This is partially illustrated in FIG. 2. The slower belt speed allows the drying chamber to heat up faster than normal because heat is not being exhausted from the chamber (due to belt speed) at the same rate as the normal (i.e., higher) belt speed. Similarly, cool air is also not being drawn into the chamber at the same rate as the normal belt speed. This slower belt speed more efficiently (and therefore cost effectively) allows the dryer to warm up faster than normal. Once the drying chamber is near or at its typical drying temperature, the controller 38 increases the belt 12 to its normal or typical speed. The "normal" speed may depend on various factors, such as the type of textile being dried, type of ink used or other material(s) applied to the textile that requires drying, ambient moisture, etc.

In accordance with another embodiment of the invention, the controller 38 is programmed to increase the belt speed (above its normal or typical drying speed) during shut-down of the dryer 10. Again, as partially illustrated in FIG. 2, the increased speed increases the amount of heat exhausted through the exit 24 of the drying chamber 14 by the belt 12, as well as increases the amount of cool outer air drawn through the opening 22. The chamber 14 must be cooled prior to stopping the belt 12. Otherwise, the portion of the belt 12 left in the chamber 14 could melt if it is not moving.

In accordance with another embodiment of the invention, the controller is configured to increase or decrease the temperature during a drying run—by either increasing or decreasing the belt speed—depending on fluctuations of temperature in the drying chamber 14. Such fluctuations may occur, for example, by fluctuations of the heating elements, or changes in the ambient conditions, etc. The controller 38 monitors the temperature of the chamber 14 using the temperature probe 36. When the temperature moves a predetermined amount (e.g., 10° up or down), then the controller 38 signals the belt drive to increase or decrease the belt speed as appropriate. The controller 38 can concurrently adjust the heating elements in addition to adjusting the belt speed. Specifically, the controller can turn up the heating elements to increase the temperature in the chamber, or turn down the heating elements to decrease the temperature in the chamber. This control of the heating elements, combined with adjustments of the belt speed, decreases the amount of time to adjust the chamber temperature than use of either method alone.

Figure 3:
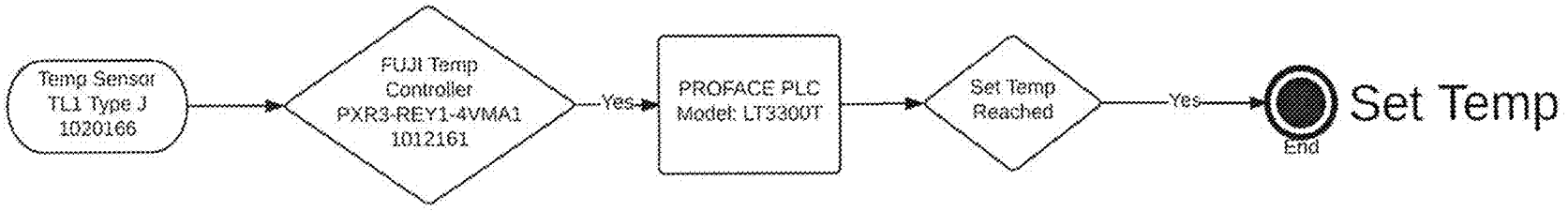
FIG. 3 is a process flow chart for sensing the temperature of the drying chamber of the textile dryer of FIG. 1.
Figure 4:
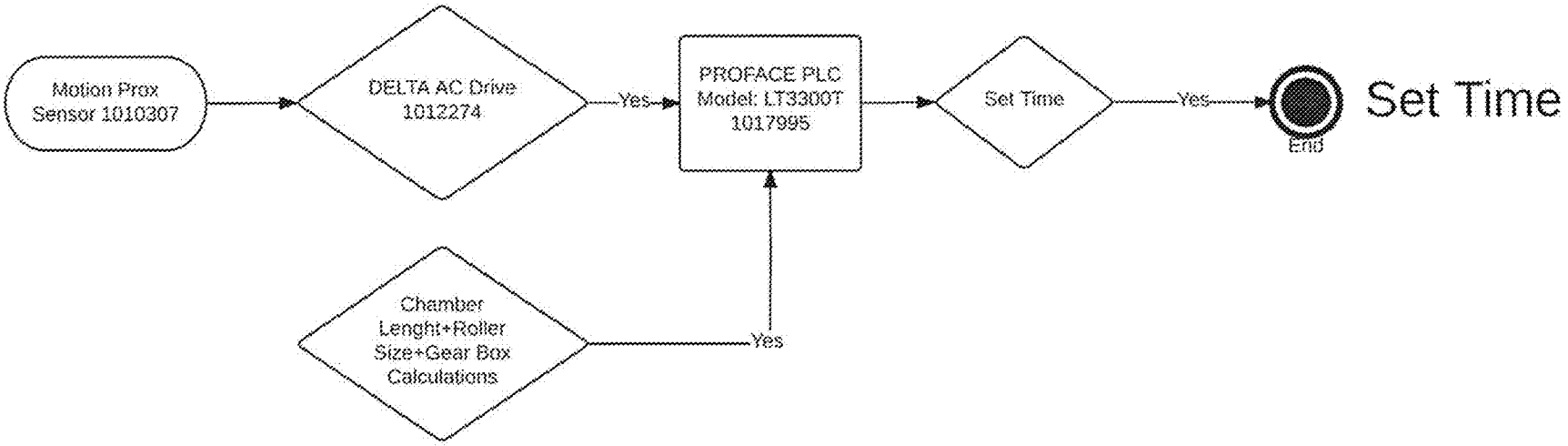
FIG. 4 is a process flow chart for sensing motion of the belt of the textile dryer of FIG. 1.

FIG. 3 illustrates an information flow for sensing temperature of the drying chamber 14 by the controller 38 from the temperature probe 36. FIG. 4 illustrates an information flow of the motion proximity sensor 40 communicating with the controller 38.

Many modifications and variations of the present invention are possible in light of the above teachings. It is, therefore, to be understood within the scope of the appended claims the invention may be protected otherwise than as specifically described.

We claim:

1. A method for controlling temperature in a textile dryer comprising:

providing a textile dryer having a drying chamber having a first opening at a first end and a second opening at a second end;

providing a movable belt for moving textiles through the drying chamber, the movable belt having a portion of the belt extending outward from the first opening and a portion of the belt extending outward from the second opening;

measuring fluxations of temperature in the drying chamber;

controlling a speed of the belt with a controller to control a rate of ambient air being drawn into the drying chamber through the first opening by the movable belt and a rate of air being exhausted from the drying chamber through the second opening by the movable belt to change the temperature of the drying chamber.

2. The method of claim 1 further comprising:

providing heating elements in the drying chamber.

3. The method of claim 2 further comprising adjusting the heating elements in the dryer with the controller concurrently with the step of controlling a speed of the belt to change the temperature in the drying chamber.

4. The method of claim 3 wherein the step of adjusting the heating elements in the dryer with the controller concurrently with the step of controlling a speed of the belt to change the temperature in the drying chamber comprises:

turning up the heating elements to increase the temperature in the drying chamber.

5. The method of claim 3 wherein the step of adjusting the heating elements in the dryer with the controller concurrently with the step of controlling a speed of the belt to change the temperature in the drying chamber comprises:

turning down the heating elements to decrease the temperature in the drying chamber.

6. The method of claim 1 wherein the step of controlling a speed of the belt with a controller to control a rate of ambient air being drawn into the drying chamber through the first opening by the movable belt and a rate of air being exhausted from the drying chamber through the second opening by the movable belt to change the temperature of the drying chamber comprises:

increasing the speed the belt speed by the controller.

7. The method of claim 1 wherein the step of controlling a speed of the belt with a controller to control a rate of ambient air being drawn into the drying chamber through the first opening by the movable belt and a rate of air being exhausted from the drying chamber through the second opening by the movable belt to change the temperature of the drying chamber comprises:

decreasing the speed the belt speed by the controller.

8. The method of claim 1 wherein the step of controlling a speed of the belt with a controller to control a rate of ambient air being drawn into the drying chamber through the first opening by the movable belt and a rate of air being exhausted from the drying chamber through the second opening by the movable belt to change the temperature of the drying chamber comprises:

increasing the belt speed by the controller during a shut-down operation of the dryer.

9. The method of claim 1 wherein the step of controlling a speed of the belt with a controller to control a rate of ambient air being drawn into the drying chamber through the first opening by the movable belt and a rate of air being exhausted from the drying chamber through the second opening by the movable belt to change the temperature of the drying chamber occurs upon sensing a temperature change in the drying chamber of a predetermined amount.

10. The method of claim 9 wherein the predetermined amount is 10°.

11. A textile dryer comprising:

a drying chamber having a first opening at a first end and a second opening at a second end;

a movable belt for moving textiles through the drying chamber, the movable belt having a portion of the belt extending outward from the first opening and a portion of the belt extending outward from the second opening;

a first temperature probe for measuring fluxations of temperature in the drying chamber;

a controller configured to control a speed of the belt to control a rate of ambient air being drawn into the drying chamber through the first opening by the movable belt and a rate of air being exhausted from the drying chamber through the second opening by the movable belt to change the temperature of the drying chamber.

12. The textile dryer of claim 11 further comprising a first a first heating element in the drying chamber coupled to the controller.

13. The textile dryer of claim 12 wherein the controller is configured to adjust the first heating element concurrently with controlling the speed of the belt.

14. The textile dryer of claim 12 wherein the controller is configured to turn up the first heating element to increase the temperature in the drying chamber.

15. The textile dryer of claim 12 wherein the controller is configured to turn down the first heating element to decrease the temperature in the drying chamber.

16. The textile dryer of claim 11 further comprising a belt motion sensor operatively coupled to the controller.

17. The textile dryer of claim 11 wherein the controller at shut down of the dryer is configured to increase the speed of the belt above a desired drying speed.

18. The textile dryer of claim 17 wherein the controller at shut-down of the dryer is configured to turn off the first heating element in the drying chamber.

19. The textile dryer of claim 11 wherein the controller is configured to increase the speed of the belt if the temperature sensed by the first temperature probe increases a predetermined amount.

20. The textile dryer of claim 11 wherein the controller is configured to decrease the speed of the belt if the temperature sensed by the first temperature probe decreases a predetermined amount.

* * * * *